US006378258B1

(12) United States Patent
Cunningham et al.

(10) Patent No.: US 6,378,258 B1
(45) Date of Patent: Apr. 30, 2002

(54) EDGE CUT TO INCREASE EFFECTIVE WIDTH OF INSULATION SHEET AND METHOD OF FORMING THE SAME

(75) Inventors: Richard Napoleon Cunningham, Aurora, CO (US); Judith A. Wunsch, Willows, CA (US)

(73) Assignee: Johns Manville International, Inc., denver, CO (US)

( * ) Notice: Subject to any disclaimer, the term of this patent is extended or adjusted under 35 U.S.C. 154(b) by 0 days.

(21) Appl. No.: 09/376,243

(22) Filed: Aug. 18, 1999

(51) Int. Cl.[7] ..... E04B 1/74
(52) U.S. Cl. ..... 52/404.1; 52/404.3
(58) Field of Search ..... 52/404.1, 404.3

(56) References Cited

U.S. PATENT DOCUMENTS 2,216,206 A * 10/1940 McKee, Jr. ..... 108/13
2,616,529 A * 11/1952 MacDonald ..... 189/1
2,857,630 A * 10/1958 Bishop ..... 20/4
2,864,324 A * 12/1958 Clements ..... 108/13
3,557,840 A * 1/1971 Maybee ..... 138/149
3,958,385 A * 5/1976 Bondra, Jr. et al. ..... 52/404.1
4,339,902 A * 7/1982 Cimochowski et al. ..... 52/506
4,384,437 A * 5/1983 Coles ..... 52/404.1
4,481,746 A * 11/1984 Cimochowski ..... 52/404.1
4,738,072 A * 4/1988 Clemensen et al. ..... 52/743
4,744,186 A * 5/1988 Smith et al. ..... 52/404.1
4,825,089 A * 4/1989 Lindsay ..... 250/515.1
4,866,905 A * 9/1989 Bihy et al. ..... 52/743
4,972,644 A * 11/1990 Rumiesz, Jr. et al. ..... 52/406
5,390,720 A * 2/1995 Colson et al. ..... 160/84.1 D
5,496,357 A * 3/1996 Jensen et al. ..... 607/108
5,551,203 A * 9/1996 Alderman et al. ..... 52/46.11
5,561,959 A * 10/1996 Alderman et al. ..... 52/407.3
5,867,956 A * 2/1999 Gregory, Jr. et al. .... 52/309.13

* cited by examiner

*Primary Examiner*—Daniel P. Stodola
*Assistant Examiner*—Khoa Tran
(74) *Attorney, Agent, or Firm*—Robert D. Touslee

(57) ABSTRACT

An insulation sheet for insulating a wall, floor, ceiling or roof cavity is flexible, compressible and resilient and has lateral edges extending the length of the sheet. The lateral edges of the sheet are formed with contours along the lengths of the lateral edges, which with the flexibility, compressibility and resilience of the insulation sheet, increase the effective width of the sheet, relative to a conventional insulation sheet of the same length, width, thickness and density with straight lateral edges extending perpendicular between the major surfaces of the conventional sheet, with no or substantially no increase in the amount of insulation material forming the sheet relative to the insulation material used in the conventional insulation sheet. The contours of the lateral edges are formed by reciprocally oscillating cutting blades in a direction transverse to the feed of a sheet past the cutting blades and/or by placing the cutting blades at an angle other than perpendicular to the major surfaces of the sheet being fed past the cutting blades or by synchronously moving the cutting blades back and forth between a negative and a positive angle as the insulation sheet is fed past the cutting blades.

5 Claims, 4 Drawing Sheets

FIG. 1
PRIOR ART
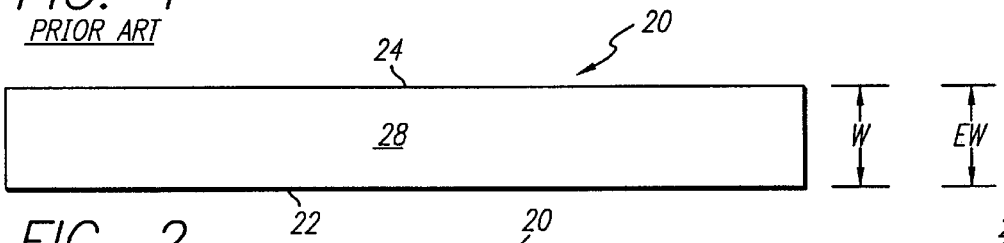
FIG. 2
PRIOR ART
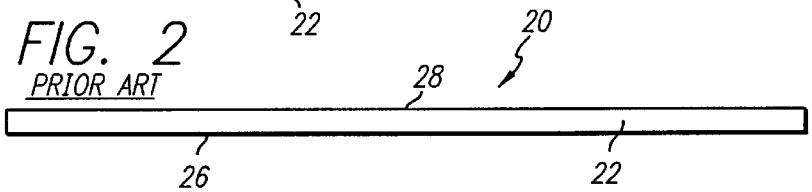
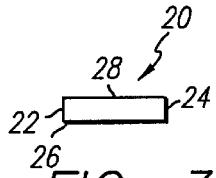
FIG. 3
PRIOR ART
FIG. 4
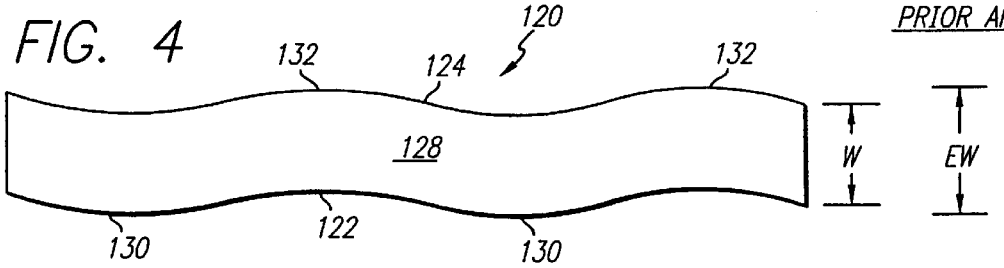
FIG. 5
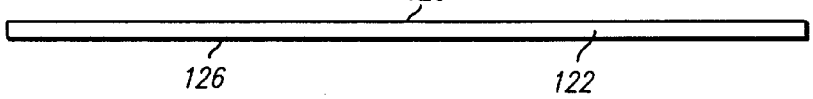
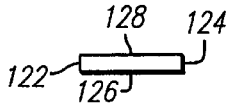
FIG. 6
FIG. 7
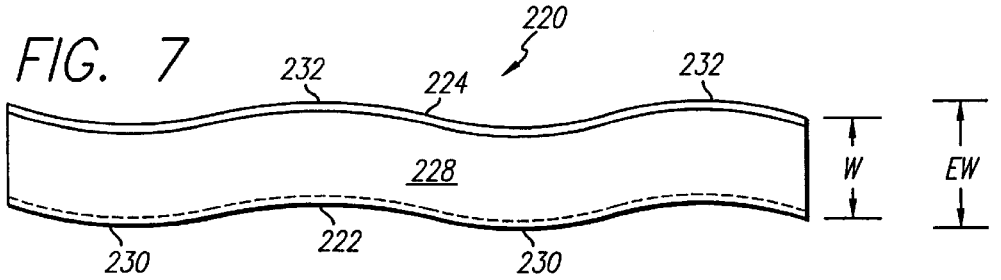
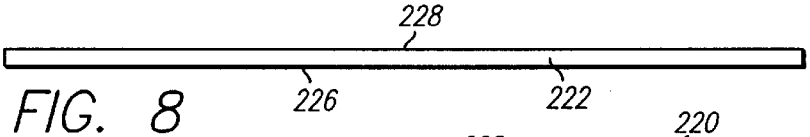
FIG. 8
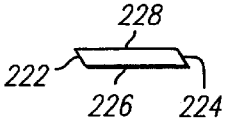
FIG. 9
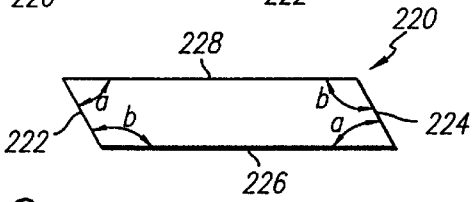
FIG. 10

FIG. 11
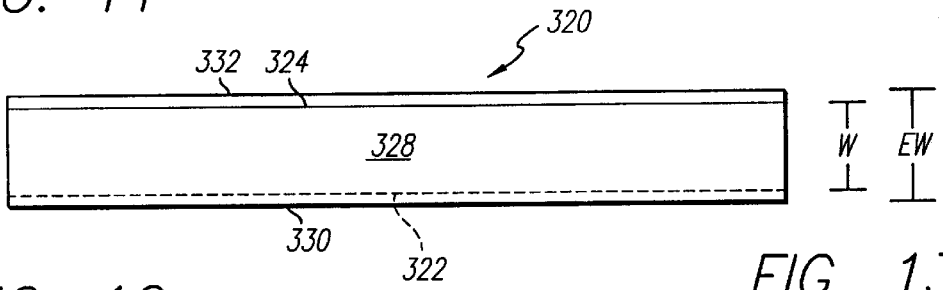
FIG. 12
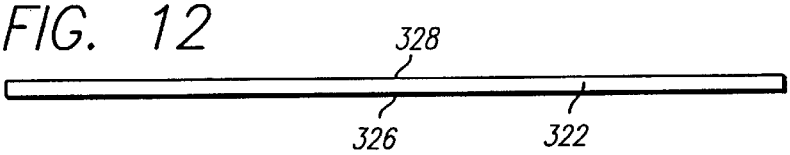
FIG. 13
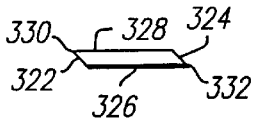
FIG. 14
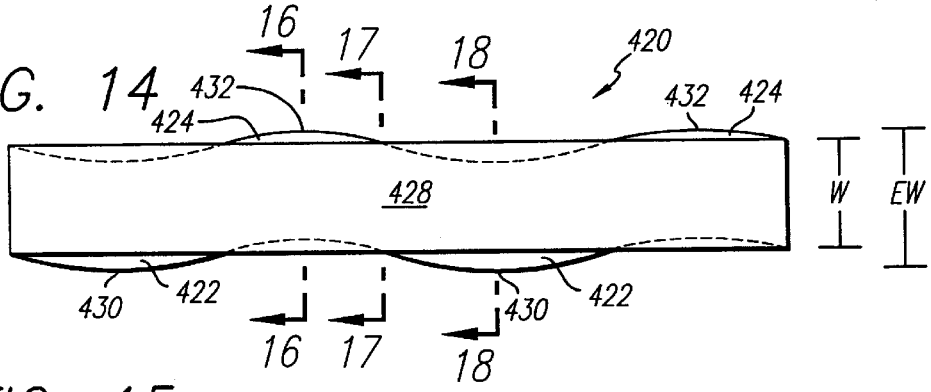
FIG. 15
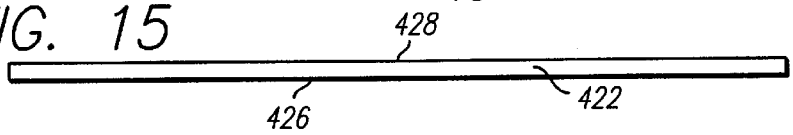
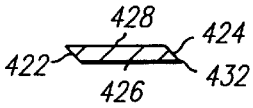
FIG. 16
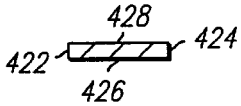
FIG. 17
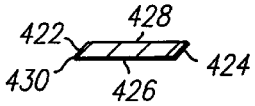
FIG. 18
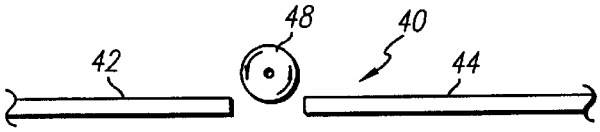
FIG. 19
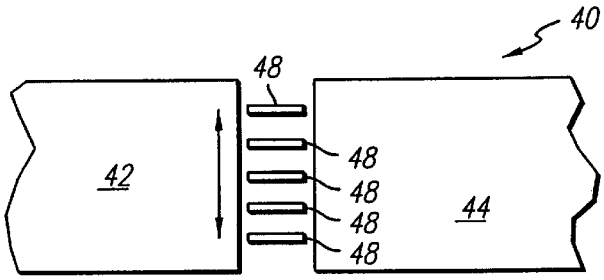
FIG. 20

46
X
120b
124
120
122
124
120
122
124
120
122
124
120
122
120a
122
X

46
X
220b
224
220
224
220
222
224
220
222
224
220
222
220a
222
X

EDGE CUT TO INCREASE EFFECTIVE WIDTH OF INSULATION SHEET AND METHOD OF FORMING THE SAME

BACKGROUND OF THE INVENTION

The present invention relates to fibrous and foam insulation sheets, such as but not limited to fibrous insulation batts or blankets for insulating wall, floor, ceiling and roof cavities and, in particular, to fibrous and foam insulation sheets which have lateral edges contoured to function, in combination with the flexibility, compressibility and resilience of the insulation sheets to increase the effective widths of the insulation sheets. When the insulation sheets are placed in a cavity, the increased effective widths of the insulation sheets increases the forces exerted on the lateral edges of the insulation sheets by the opposed surfaces of the framing members defining the cavity to better retain the insulation sheets within the cavity.

Fibrous insulation sheets, batts or blankets, such as but not limited to glass fiber insulation batts or blankets, foam insulation sheets or similar insulation batts, blankets or sheets which are flexible, compressible and resilient, are commonly used as an insulation to insulate wall, floor, ceiling and roof cavities of residential, commercial, and industrial buildings. The lengths, widths, and depths of these building cavities are standardized throughout the building industry and are defined by the framing members used in the walls, floors, ceilings and roofs of the buildings. For example, the vertical framing members in the walls of residential building construction are normally standard 2×4 or 2×6 wooden studs which are located on 16 inch or 24 inch centers and form wall cavities having widths of about 14½ and 22½ inches. The commercially available fibrous insulation batts or blankets used to insulate these wall cavities are both compressible and resilient and are made to standard nominal widths of 15 inches and 23 inches, respectively. The compressibility of the fibrous insulation batts or blankets, which are greater in width than the cavities being insulated, enables the batts or blankets to be placed within the cavities and the resilience of the batts or blankets which exert forces against the surfaces of framing members helps to maintain the insulation batts or blankets in place within the cavities prior to enclosing the cavities with boards, wall boards or similar construction materials.

While this method of maintaining the insulation sheets, batts or blankets in place within the cavities prior to putting up the wall board or similar construction materials generally works satisfactorily, sometimes the forces exerted on a sheet, batt or blanket by the framing members to maintain the insulation sheet, batt or blanket in place is insufficient to maintain the insulation sheet, batt or blanket in place. Thus, there has remained a need to better retain the insulation sheets, batts or blankets within the cavities prior to putting up the wall board or similar construction materials to enclose the cavity.

SUMMARY OF THE INVENTION

The fibrous or foam insulation sheet, batt or blanket and method of the present invention provide a means for better retaining a flexible, compressible and resilient insulation sheet, batt or blanket within a wall, floor, ceiling or roofing cavity by contouring the lateral edges of the insulation sheet, batt or blanket to increase the effective width of the insulation sheet, batt or blanket without increasing the amount of insulation used in the sheet, batt or blanket. More specifically, the insulation sheet, batt or blanket of the present invention has contoured lateral edges which are: a) serpentine, b) inclined at an angle other than perpendicular to the major surfaces of the sheet, batt or blanket, or c) a combination of serpentine and inclined at an angle other than perpendicular to the major surfaces of the sheet, batt or blanket, along the lengths of the lateral edges of the sheet, batt or blanket. These contoured lateral edges increase the effective width of the insulation sheet, batt or blanket relative to a conventional insulation sheet, batt or blanket of the same length, width, thickness and density with straight lateral edges extending perpendicular between major surfaces of the conventional insulation sheet without increasing the amount of insulation material used in the insulation sheet, batt or blanket.

As used in this specification and claims in connection with insulation sheets, batts and blankets, the term "width" means the perpendicular distance (as measured along a straight line in a plane parallel to the major surfaces of the insulation sheet, batt or blanket) between the lateral edges of an insulation sheet, batt or blanket for any and all planes, passing through the insulation sheet, batt or blanket, that are parallel to the major surfaces of the insulation sheet, batt or blanket.

As used in this specification and claims in connection with insulation sheets, batts and blankets, the term "effective width" means the perpendicular distance (as measured along a straight line in a plane parallel to the major surfaces of the insulation sheet, batt or blanket) between two parallel or substantially parallel planes extending perpendicular to the major surfaces of the insulation sheets, batts or blankets which planes meet or are tangential to the lateral edges of the insulation sheets, batts or blankets along the lengths of the lateral edges at the farthest lateral projections of the lateral edges.

In the embodiment of the present invention where the lateral edges of the insulation sheet, batt or blanket have generally serpentine contours throughout the lengths of the lateral edges and the lateral edges extend generally parallel with respect to each other throughout the lengths of the lateral edges, a transverse vertical cross section through the insulation sheet, batt or blanket may be shaped generally like a rectangle or a parallelogram with no included right angles. In the embodiment of the present invention where the lateral edges of the insulation sheet, batt or blanket are inclined at an angle other than perpendicular to the major surfaces of the insulation sheet, batt or blanket throughout the lengths of the lateral edges, a transverse vertical cross section through the insulation sheet, batt or blanket is shaped generally like a parallelogram having no included right angles. In another embodiment of the present invention, the lateral edges of the insulation sheet, batt or blanket are substantially straight at one major surface of the sheet, serpentine at the other major surface of the sheet, and the angles of the lateral edges relative to the major surfaces of the sheet periodically vary along the length of the lateral edges from inclined at a negative angle to the perpendicular (the perpendicular between the major surfaces), to perpendicular, to inclined at a positive angle to the perpendicular, to perpendicular, to inclined at a negative angle to the perpendicular.

With the contours of the lateral edges of the insulation sheet, batt or blanket of the present invention there is no or substantially no increase in the amount of insulation material forming the insulation sheet, batt or blanket of the present invention relative to the insulation material used in a conventional insulation sheet, batt or blanket of the same length, width, thickness and density with straight lateral edges extending perpendicular between major surfaces of the insulation sheet, batt or blanket. However, with the increase in the effective width of the insulation sheet, batt or blanket of the present invention, when the insulation sheet, batt or blanket is placed in a cavity the forces exerted on the lateral edges of the insulation sheet, batt or blanket by the opposed surfaces of the framing members are increased to better retain the insulation sheet, batt or blanket within the cavity.

In a first embodiment of the method of forming the contoured edges on the insulation sheets, batts or blankets of the present invention, the contoured edges are formed by cutting an insulation sheet with a series of spaced apart cutting blades that are reciprocally oscillated with respect to the insulation sheet in a direction transverse to a longitudinal centerline of the insulation sheet as the insulation sheet is fed past the cutting blades. The reciprocal oscillation of the blades, as the insulation sheet is fed past the blades, forms a plurality of sheets, batts or blankets with serpentine lateral edges that extend generally parallel with respect to each other.

In a second embodiment of the method of forming the contoured edges on the insulation sheets, batts or blankets of the present invention, the contoured edges are formed by cutting an insulation sheet with a series of stationary, spaced apart cutting blades that are positioned across the width of the insulation sheet. The cutting blades are inclined at an angle other than perpendicular to the major surfaces of the insulation sheet and as the insulation sheet is fed past the cutting blades, a plurality of sheets, batts or blankets are formed with lateral edges inclined at angles other than perpendicular to the major surfaces of the insulation sheets throughout the lengths of the lateral edges. The insulation sheets, batts or blankets formed have a transverse vertical cross section that is shaped generally like a parallelogram having no included right angles.

In a third embodiment of the method of forming the contoured edges on the insulation sheets, batts or blankets of the present invention, the contoured edges are formed by cutting an insulation sheet with a series of stationary, spaced apart cutting blades that are positioned across the width of the insulation sheet. While the spaced apart cutting blades are maintained in fixed positions relative to the insulation sheet in a direction transverse to a longitudinal centerline of the insulation sheet as the insulation sheet is fed through the cutting station, the cutting blades of the cutting means, which are maintained parallel with respect to each other, are moved synchronously back and forth between a negative angle to the perpendicular between the major surfaces of the insulation sheet and a positive angle to the perpendicular between the major surfaces of the insulation sheet. This method of cutting the insulation sheet forms a plurality of insulation sheets with lateral contoured edges that extend generally parallel with respect to each other. The lateral edges are substantially straight at a first major surface throughout the lengths of the lateral contoured edges and are generally serpentine at a second major surface throughout the lengths of the lateral contoured edges.

BRIEF DESCRIPTION OF THE DRAWINGS

FIGS. 1–3 are schematic top, side and end views of a typical prior art insulation sheet for insulating a wall, floor, ceiling or roof cavity of a building.

FIGS. 4–6 are schematic top, side and end views of a first embodiment of the insulation sheet of the present invention for insulating a wall, floor, ceiling or roof cavity of a building.

FIGS. 7–9 are schematic top, side and end views of a second embodiment of the insulation sheet of the present invention for insulating a wall, floor, ceiling or roof cavity of a building.

FIG. 10 is a schematic end view of the insulation sheets of FIGS. 7–9 and 11–13, in a larger scale, to better illustrate the included angles of the insulation sheet in transverse cross section.

FIGS. 11–13 are schematic top, side and end views of a third embodiment of the insulation sheet of the present invention for insulating a wall, floor, ceiling or roof cavity of a building.

FIGS. 14–15 are schematic top and side views of a fourth embodiment of the insulation sheet of the present invention for insulating a wall, floor, ceiling or roof cavity of a building.

FIGS. 16–18 are schematic transverse cross sectional views of the insulation sheet of FIGS. 14 and 15 taken substantially along lines 16—16, 17—17 and 18—18 of FIG. 14.

FIGS. 19 and 20 are schematic top and side views of an apparatus for forming the insulation sheets of the present invention.

DESCRIPTION OF THE PREFERRED EMBODIMENTS

Figure 21:
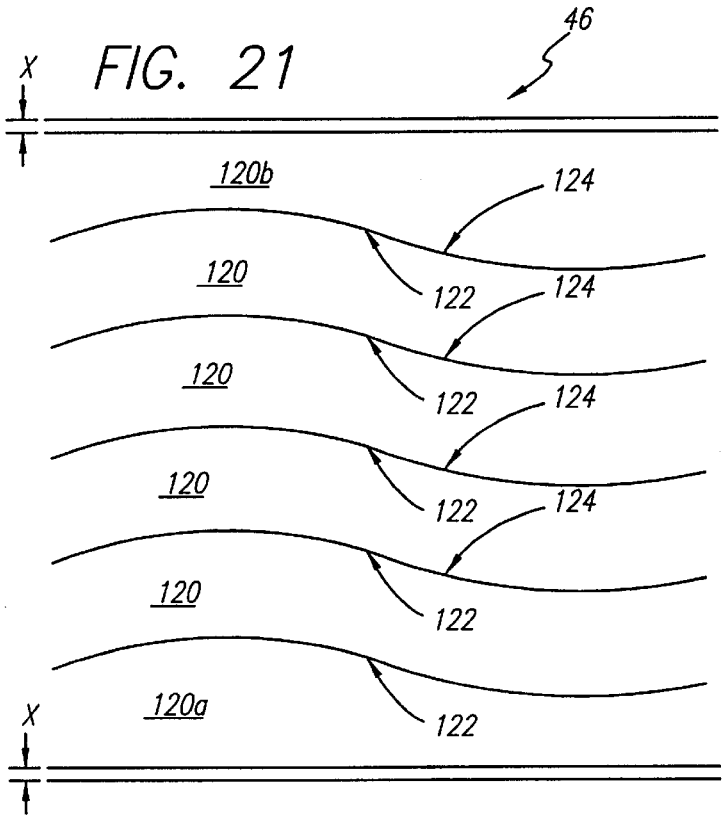
FIG. 21 is a top view of an insulation sheet cut into a series of insulation sheets such as the insulation sheets illustrated in FIGS. 4–6.
Figure 23:
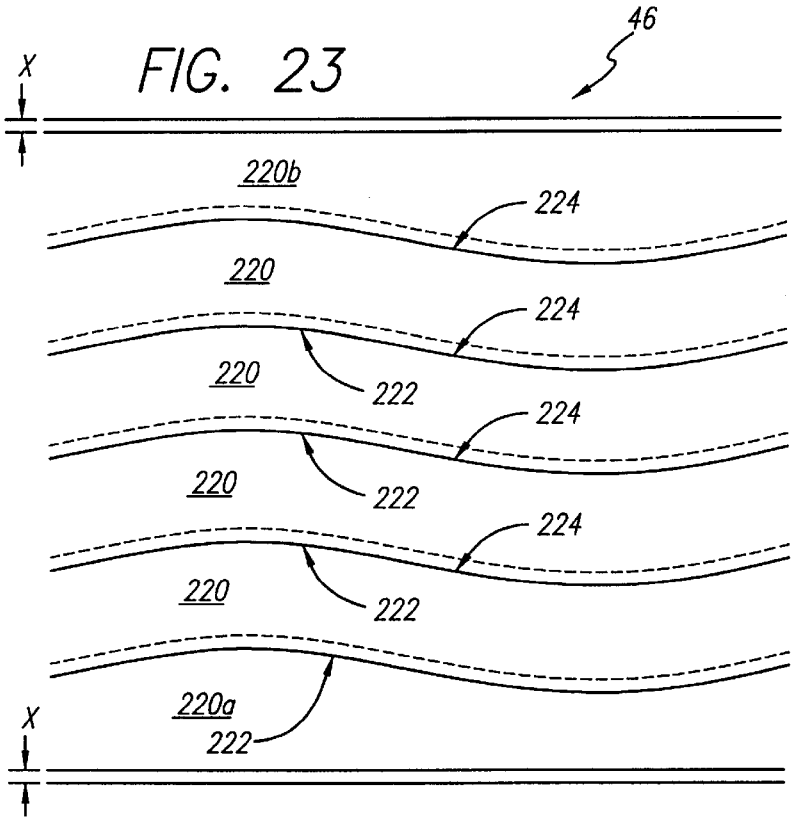
FIG. 23 is a top view of an insulation sheet cut into a series of insulation sheets such as the insulation sheets illustrated in FIGS. 7–9.

FIGS. 1–3 show a conventional fibrous or foam insulation sheet 20 for insulating the wall, floor, ceiling and roof cavities of buildings and similar structures. Typically, the insulation sheets 20 are made of fibrous materials such as but not limited to mineral fiber insulation sheets, batts and blankets (e.g. glass, mineral wool), and foam materials such as but not limited to polyimide or polyamide foam insulation sheets. The insulation sheet 20 typically comes in various lengths and thickness, such as but not limited to lengths ranging from about 8 feet to about 100 feet and thickness ranging from about 3 inches to about 6½ inches. Since the lateral edges 22 and 24 of the insulation sheet 20 are parallel with respect to each other and extend perpendicular to the major surfaces 26 and 28 of the insulation sheet 20, the width "W" of the insulation sheet and the effective width "EW" of the insulation sheet 20 are the same. These insulation sheets typically range from about 10 inches to about 24 inches in width with insulation sheets about 15 inches wide and about 23 inches wide being the most common.

FIGS. 4–18 show fibrous or foam insulation sheet 120, 220, 320 and 420 for insulating the wall, floor, ceiling and roof cavities of buildings and similar structures. Typically, the insulation sheets 120, 220, 320 and 420 are made of fibrous materials such as but not limited to mineral fiber insulation sheets, batts and blankets, and foam materials such as but not limited to polyimide or polyamide foam insulation sheets. The insulation sheets typically come in various lengths and thickness, such as but not limited to lengths ranging from about 8 feet to about 100 feet and thickness ranging from about 3 inches to about 6½ inches.

The insulation materials forming the insulation sheets 120, 220, 320 and 420, such as mineral fiber insulation batts or blanket or foam insulation sheets must be flexible, compressible and resilient. The insulation sheets 120, 220 320 and 420 formed from the insulation materials must also be flexible, compressible and resilient so that when an insulation sheet 120, 220, 320 or 420 is placed between the opposed surfaces of the generally parallel extending framing members defining the width of a wall, floor, ceiling or roof cavity, the insulation sheet can flex and compress or deform along its length to conform the lateral edges of the insulation sheet to the surfaces of cavity sidewalls defined by the opposed surfaces of the framing members and resiliently press against the opposed surfaces of the framing members to hold the insulation sheet in place by the opposing forces exerted on the insulation sheet by framing members. In addition, since the lateral edges of the insulation sheets 120, 220, 320 and 420 are contoured or shaped to increase the effective widths "EW" of the insulation sheets relative to the widths "W" of the insulation sheets 120, 220, 320 and 420 and cross sections of the insulations sheets taken anywhere along the lengths of the insulation sheets in planes extending perpendicular to both the major surfaces and the parallel edges of the insulation sheets are rectangles or parallelograms, the effective widths "EW" of the insulation sheets 120, 220, 320 and 420 are increased to more effectively maintain the insulation sheets within wall, floor, ceiling and roof cavities without increasing the amount of insulation material used in the insulation sheets.

By way of example, in a wall cavity used in residential construction the distance between the opposed surfaces of the framing members defining the widths of the cavities is typically about 14½ or about 22½ inches and the widths "W" as well as the effective widths "EW" of the conventional insulation sheets 20 used to insulate such cavities are typically about 15 and 23 inches respectively. Since the widths "W" as well as the effective widths "EW" of the insulation sheets are about ½ inch greater than the cavity widths, the forces between the lateral edges of the insulation sheets and the sidewalls of the cavities, generated by the resilience of the ½ inch of resilient insulation material, act to maintain the insulation sheets in place during construction. With the insulation sheets of the present invention (sheets 120, 220, 320 and 420), the effective widths "EW" of the insulation sheets can be easily increased, e.g. by another ½ inch to an inch or more, without increasing the amount of insulation material in the sheets to increase the forces maintaining the insulation sheets in place.

In the insulation sheet 120 of FIGS. 4–6, the lateral edges 122 and 124 of the insulation sheet, batt or blanket have generally serpentine contours throughout the lengths of the lateral edges and the lateral edges 122 and 124 extend parallel or substantially parallel with respect to each other throughout the lengths of the lateral edges. In addition, the lateral edges are perpendicular or substantially perpendicular to the major surfaces 126 and 128 of the insulation sheet 120 and a transverse vertical cross section through the insulation sheet, batt or blanket is shaped generally like a rectangle.

As best shown in FIG. 4, due to the serpentine contour of the lateral edges 122 and 124, the effective width "EW" of the insulation sheet 120 [the perpendicular distance (as measured along a straight line in a plane parallel to the major surfaces 126 and 128 of the insulation sheet 120) between two parallel or substantially parallel planes extending perpendicular to the major surfaces of the insulation sheet which planes meet or are tangential to the lateral edges 126 and 128 of the insulation sheet along the lengths of the lateral edges at the farthest lateral projections 130 and 132 of the lateral edges] is greater than the width "W" of the insulation sheet [the perpendicular distance (as measured along a straight line in a plane parallel to the major surfaces 126 and 128 of the insulation sheet 120) between the lateral edges 122 and 124 of an insulation sheet for any and all planes, passing through the insulation sheet 120, that are parallel to the major surfaces of the insulation sheet. Desirably, the distance between a lateral projection 130 and the next succeeding lateral projection 130 along the lateral edge 122 and a lateral projection 132 and the next succeeding lateral projection 132 along the lateral edge 124 each ranges from about 2 to about 4 feet.

In the insulation sheet 220 of FIGS. 7–9, the lateral edges 222 and 224 of the insulation sheet, batt or blanket have generally serpentine contours throughout the lengths of the lateral edges and the lateral edges 222 and 224 extend parallel or substantially parallel with respect to each other throughout the lengths of the lateral edges. In addition, the lateral edges are inclined at an angle to the perpendicular to the major surfaces 226 and 228 of the insulation sheet 220 and a transverse vertical cross section through the insulation sheet is shaped generally like a parallelogram having no included right angles. As best shown in FIG. 7, due to the serpentine contour of the lateral edges 222 and 224 and the incline of the lateral edges 222 and 224 relative to the perpendicular to the major surfaces 226 and 228 of the insulation sheet, the effective width "EW" of the insulation sheet 220 [the perpendicular distance (as measured along a straight line in a plane parallel to the major surfaces 226 and 228 of the insulation sheet 220) between two parallel or substantially parallel planes extending perpendicular to the major surfaces of the insulation sheet which planes meet or are tangential to the lateral edges 226 and 228 of the insulation sheet along the lengths of the lateral edges at the farthest lateral projections 230 and 232 of the lateral edges] is greater than the width "W" of the insulation sheet [the perpendicular distance (as measured along a straight line in a plane parallel to the major surfaces 226 and 228 of the insulation sheet 220) between the lateral edges 222 and 224 of an insulation sheet for any and all planes, passing through the insulation sheet 220, that are parallel to the major surfaces of the insulation sheet. Due to the inclination of the lateral edges 222 and 224 to the perpendicular, the farthest lateral projections 230 along lateral edge 222 occur where the lateral edge 222 meets the major surface 228 of the insulation sheet and the farthest lateral projections 232 along lateral edge 224 occur where the lateral edge meets the major surface 226. Desirably, the distance between a lateral projection 230 and the next succeeding lateral projection 230 along the lateral edge 222 and a lateral projection 232 and the next succeeding lateral projection 232 along the lateral edge 224 each ranges from about 2 to about 4 feet.

As best shown in FIG. 10, the included angles "a" and "b" between the lateral edges 222 and 224 and the major surfaces 226 and 228 in a transverse cross section of the insulation sheet 220 are other than right angles with the included angles "a" being acute angles and the included angles "b" being obtuse angles. Desirably, the angles "a" range from about 60° to about 85° and the angles "b" range from about 95° to about 120°.

In the insulation sheet 320 of FIGS. 11–13, the lateral edges of the insulation sheet, batt or blanket are inclined at an angle to the perpendicular to the major surfaces 326 and 328 of the insulation sheet and are parallel with respect to each other throughout the lengths of the lateral edges 322 and 324. In addition, a transverse cross section through the insulation sheet perpendicular to the major surfaces of the insulation sheet is shaped generally like a parallelogram having no included right angles. As best shown in FIG. 11, due to the incline of the lateral edges 322 and 324 relative to the perpendicular to the major surfaces 326 and 328 of the insulation sheet, the effective width "EW" of the insulation sheet 320 [the perpendicular distance (as measured along a straight line in a plane parallel to the major surfaces 326 and 328 of the insulation sheet 320) between two parallel or substantially parallel planes extending perpendicular to the major surfaces of the insulation sheet which planes meet the lateral edges 326 and 328 of the insulation sheet along the lengths of the lateral edges at the farthest lateral projections 330 and 332 of the lateral edges] is greater than the width "W" of the insulation sheet [the perpendicular distance (as measured along a straight line in a plane parallel to the major surfaces 326 and 328 of the insulation sheet 320) between the lateral edges 322 and 324 of an insulation sheet for any and all planes, passing through the insulation sheet 320, that are parallel to the major surfaces of the insulation sheet. Due to the inclination of the lateral edges 322 and 324 to the perpendicular, the farthest lateral projection 330 along lateral edge 322 occurs where the lateral edge 322 meets the major surface 328 of the insulation sheet and the farthest lateral projection 332 along lateral edge 324 occurs where the lateral edge meets the major surface 326.

As with the transverse cross section of insulation sheet 220, the included angles "a" and "b" between the lateral edges 322 and 324 and the major surfaces 326 and 328 in a transverse cross section of the insulation sheet 320 are other than right angles with the included angles "a" being acute angles and the included angles "b" being obtuse angles. Desirably, the angles "a" range from about 60° to about 85° and the angles "b" range from about 95° to about 120°.

In the insulation sheet 420 of FIGS. 14–18, the lateral edges 422 and 424 of the insulation sheet, batt or blanket are substantially straight and parallel with respect to each other at one major surface 428 of the sheet, serpentine and parallel with respect to each other at the other major surface 426 of the sheet, and the angles of the lateral edges 422 and 424 relative to the major surfaces 426 and 428 of the sheet periodically vary along the length of the lateral edges from inclined at a negative angle to the perpendicular (the perpendicular between the major surfaces), to perpendicular, to inclined at a positive angle to the perpendicular, to perpendicular, to inclined at a negative angle to the perpendicular. FIGS. 16–18 are transverse cross sections of the insulation sheet 420, extending perpendicular to the major surfaces of the insulation sheet, at different locations along the length of the insulation sheet. FIG. 16 shows the lateral edges 422 and 424 inclined at a negative angle of desirably up to about 30° to the perpendicular between the major surfaces 426 and 428 of the insulation sheet.

FIG. 17 shows the lateral edges 422 and 424 inclined perpendicular to the major surfaces 426 and 428 of the insulation sheet. FIG. 18 shows the lateral edges 422 and 424 inclined at a positive angle of desirably up to about 30° to the perpendicular between the major surfaces 426 and 428 of the insulation sheet. Thus, along the length of the insulation sheet 420, the transverse cross section of the insulation sheet 420 passes from a parallelogram with no included right angles when the lateral edges are inclined at a negative angle (FIG. 16), to a rectangle (FIG. 17), to a parallelogram with no included right angles when the lateral edges are inclined at a positive angle (FIG. 18), back to a rectangle (FIG. 17), etc. The included angles between the lateral edges 422 and 424 and the major surfaces 426 and 428 in the transverse cross sections of the insulation sheet shown in FIGS. 16 and 18 are other than right angles with the included acute angles preferably ranging from about 60° to about 85° and the included obtuse angles preferably ranging from about 95° to about 120°.

As best shown in FIG. 14, due to the serpentine contour of the lateral edges 422 and 424 where the lateral edges meet the major surface 426, the effective width "EW" of the insulation sheet 420 [the perpendicular distance (as measured along a straight line in a plane parallel to the major surfaces 426 and 428 of the insulation sheet 420) between two parallel or substantially parallel planes extending perpendicular to the major surfaces of the insulation sheet which planes meet or are tangential to the lateral edges 426 and 428 of the insulation sheet along the lengths of the lateral edges at the farthest lateral projections 430 and 432 of the lateral edges] is greater than the width "W" of the insulation sheet [the perpendicular distance (as measured along a straight line in a plane parallel to the major surfaces 426 and 428 of the insulation sheet 420) between the lateral edges 422 and 424 of an insulation sheet for any and all planes, passing through the insulation sheet 420, that are parallel to the major surfaces of the insulation sheet. Desirably, the distance between a lateral projection 430 and the next succeeding lateral projection 430 along the lateral edge 422 and a lateral projection 432 and the next succeeding lateral projection 432 along the lateral edge 424 each ranges from about 2 to about 4 feet.

FIGS. 19 and 20 are schematic plan and side views of a cutting station 40 for forming the insulation sheets 120, 220, 320 and 420 by the method of the present invention. The cutting station includes support surfaces 42 and 44 for supporting an insulation sheet 46 as the insulation sheet is passed through the cutting station 40 and a series of cutting blades 48 positioned across the width of the cutting station in a direction perpendicular to the movement of the insulation sheet 46 through the cutting station 40. Successive cutting blades 48 of the series of cutting blades are equally spaced from each other across the width of the cutting station to form a series of insulation sheets 120, 220, 320 or 420 of equal width. While, as shown, the cutting blades 48 are circular rotary saw blades, other forms of cutting blades can be used such as but not limited to band saw blades.

In a first embodiment of the method of forming the contoured edges on the insulation sheets 120 of the present invention, the contoured edges 122 and 124 are formed by cutting the insulation sheet 46 with the series of spaced apart cutting blades 48 by reciprocally oscillating the cutting blades 48 back and forth with respect to the insulation sheet 46 in a direction transverse to a longitudinal centerline of the insulation sheet as the insulation sheet is fed past the cutting blades 48. In this embodiment of the method of the present invention, the saw blades 48 are oriented perpendicular to the upper major surface of the insulation sheet 46 and the lateral edges 122 and 124, formed on the insulation sheets 120 made from the insulation sheet 46, extend perpendicular to the major surfaces of the insulation sheet 46. As shown in FIG. 21, the reciprocal oscillation of the cutting blades 48, as the insulation sheet 46 is fed past the cutting blades 48, forms serpentine lateral edges 122 and 124 on the insulation sheets 120 that extend parallel or generally parallel with respect to each other for the length of the insulation sheets 120. The length of the transverse movement of the cutting blades is determined by the increase desired in the effective width of the insulation sheets 120. However, by way of example, when forming a series of 15 inch or 23 inch wide insulation sheets 120 for insulating wall cavities, the cutting blades 48 would be moved transversely from about ½ inch to about 1 inch to increase the effective widths "EW" of the insulation sheets to about 15½–16 inches or 23½–24 inches respectively with the reciprocal motion of the saw blades being repeated for every 2 to 4 feet of movement of the insulation sheet 46 past the saw blades. The effective widths "EW" of insulation sheets of other widths, e.g. widths ranging from about 10 inches to about 24 inches, can also be increased in a like manner.

As shown in FIG. 21, the outermost insulation sheets 120*a* and 120*b* formed from the insulation sheet 46 by this process would have one straight edge and one serpentine edge. Since the serpentine edges are only on one side of each of these outer sheets, the effective widths "EW" of these two outermost insulation sheets 120*a* and 120*b* would be the same as the widths "W" of the inner insulation sheets 120. However, by making the insulation sheet 46 "X" of an inch wider on each side as shown in FIG. 21, e.g. increasing the width of the insulation sheet by ¼ to ½ inch on each side, the effective widths "EW" of the outermost insulation sheets 120*a* and 120*b* can also be increased.

Figure 22:
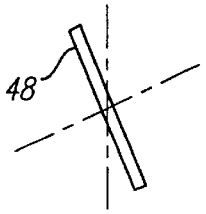
FIG. 22 is a schematic vertical end view of one of a series of saw blades positioned relative to each other as shown in FIG. 20 but inclined to cut an insulation sheet into a series of insulation sheets such as the insulation sheets illustrated in FIGS. 7–9.

The method for forming the insulation sheets 220 of the present invention is essentially the same as the method for forming the insulation sheets 120 with one exception. The saw blades 48, as shown in FIG. 22, are each inclined at the same angle to the perpendicular to the major surfaces of the insulation sheet 46. Thus, the lateral edges 222 and 224 formed on the insulation sheets 220 by cutting the insulation sheet 46 are inclined at angles other than the perpendicular to the major surfaces of the insulation sheets 220. By combining the formation of inclined lateral edges with the formation of the serpentine lateral edges, the effective widths "EW" of the insulation sheets are determined by both the inclination of the saw blades and the degree of transverse movement of the saw blades. As with the insulation sheets 120*a* and 120*b* , the outermost insulation sheets 220*a* and 220*b* can have their effective widths increased by increasing the width of the insulation sheet 46 increased by "X" of an inch on each side.

Figure 24:
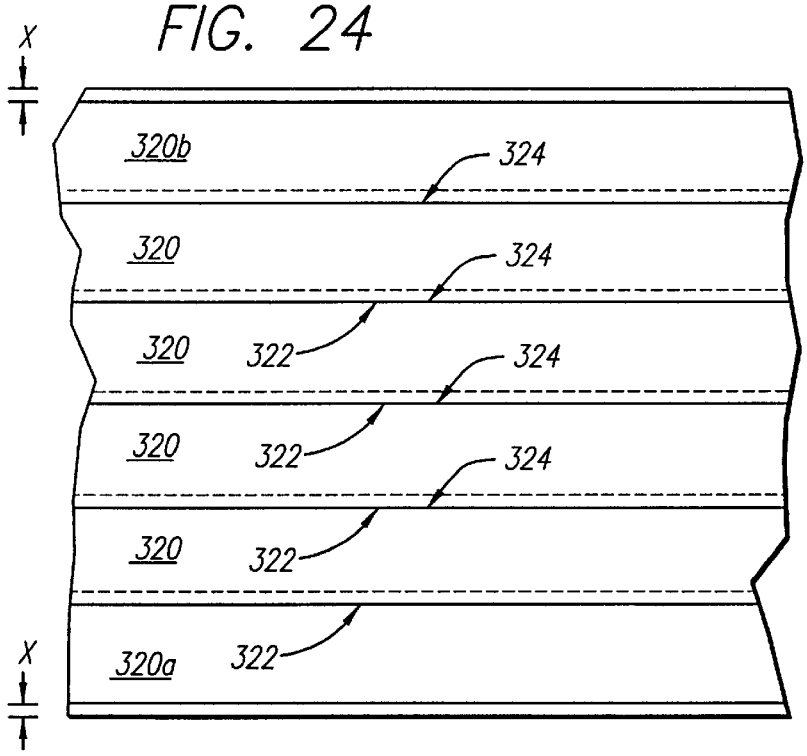
FIG. 24 is a top view of an insulation sheet cut into a series of insulation sheets such as the insulation sheets illustrated in FIGS. 11–13.

In another embodiment of the method of forming the contoured edges on the insulation sheets 320 of the present invention, the contoured edges 322 and 324 are formed by cutting the insulation sheet 46 with the series spaced apart cutting blades 48. However, in this embodiment of the method, the cutting blades 48 are maintained in a stationary position across the width of the insulation sheet 46 and are inclined at an angle other than the perpendicular to the major surfaces of the insulation sheet 46. As the insulation sheet 46 is fed past the inclined cutting blades 48, a plurality of sheets 320 are formed (as shown in FIG. 24) with lateral edges 322 and 324 inclined at angles other than the perpendicular to the major surfaces of the insulation sheets throughout the lengths of the lateral edges. As with the insulation sheets 120*a* and 120*b* , the outermost insulation sheets 320*a* and 320*b* can have their effective widths increased by increasing the width of the insulation sheet 46 increased by "X" of an inch on each side.

Figure 25:
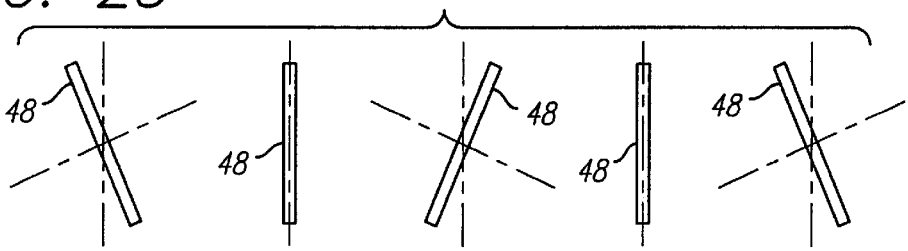
FIG. 25 is a schematic vertical end view of one of a series of saw blades positioned relative to each other as shown in FIG. 20 but being moved back and forth between a negative incline and a positive incline relative to the vertical to cut an insulation sheet into a series of insulation sheets such as the insulation sheets illustrated in FIGS. 14–18.
Figure 26:
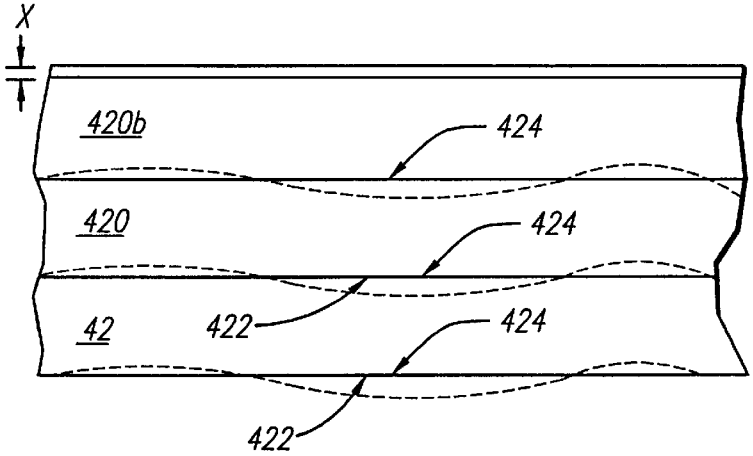
FIG. 26 is a top view of an insulation sheet cut into a series of insulation sheets such as the insulation sheets illustrated in FIGS. 14–18.

In another embodiment of the method of forming the contoured edges on the insulation sheets 420 of the present invention, the contoured edges 422 and 424 are formed by cutting the insulation sheet with the series of spaced apart cutting blades 48. The saw blades 48 are maintained in stationary or fixed positions across the width of the insulation sheet 46 as the insulation sheet is fed through the cutting station 40. However, as schematically shown with respect to a single saw blade in FIG. 25, the cutting blades 48, which are maintained parallel with respect to each other, are moved synchronously back and forth from a negative angle to the perpendicular between the major surfaces of the insulation sheet, to the perpendicular, a positive angle to the perpendicular between the major surfaces of the insulation sheet, back to the perpendicular, and so forth. This method of cutting the insulation sheet 46 forms a plurality of insulation sheets 420 with lateral contoured edges 422 and 424 that extend parallel or generally parallel with respect to each other. The lateral edges 422 and 424 are substantially straight at a first major surface throughout the lengths of the lateral contoured edges and are generally serpentine at a second major surface throughout the lengths of the lateral contoured edges. As with the insulation sheets 120*a* and 120*b* , the outermost insulation sheets 420*a* and 420*b* (only 420*b* is shown) can have their effective widths increased by increasing the width of the insulation sheet 46 increased by "X" of an inch on each side.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. An insulation sheet for insulating a wall, floor, ceiling or roof cavity having a length, width and depth wherein the width and depth of the cavity are defined by opposed, parallel surfaces of framing members spaced apart a predetermined distance, comprising:

a flexible, compressible and resilient insulation sheet; the insulation sheet having a length defined by end edges, a width and an effective width defined by lateral edges which extend the length, of the insulation sheet; first and second major surfaces defined by the end edges and the lateral edges of the insulation sheet; a thickness defined by the first and second major surfaces of the insulation sheet; the lateral edges of the insulation sheet having contours along the lengths of the lateral edges of the insulation sheet which cause the effective width of the insulation sheet to be greater than the width of the insulation sheet; the width of the insulation sheet being perpendicular distances between the lateral edges of the insulation sheet as measured in planes extending parallel to the first and second major surfaces of the insulation sheet; and the effective width of the insulation sheet being perpendicular distances, measured in planes extending parallel to the first and second major surfaces of the insulation sheet, between parallel or substantially parallel planes extending perpendicular to the first and second major surfaces of the insulation sheet which pass through farthest lateral projections of the lateral edges of the insulation sheet whereby when the insulation sheet is placed in a cavity of predetermined width about equal to the width of the insulation sheet the forces exerted on the lateral edges of the compressible and resilient insulation sheet by the opposed surfaces of the framing members are increased to retain the insulation sheet within the cavity.

2. The insulation sheet according to claim 1, wherein:

the lateral edges of the insulation sheet have generally serpentine contours throughout the lengths of the lateral edges and the lateral edges extend generally parallel with respect to each other throughout the lengths of the lateral edges.

3. The insulation sheet according to claim 2, wherein:

a transverse vertical cross section through the insulation sheet is shaped generally like a rectangle.

4. The insulation sheet according to claim 2, wherein:

the insulation sheet is a fibrous blanket; the effective width of the fibrous blanket is at least ½ inch greater than the width of the fibrous blanket at any given point along the length of the fibrous blanket; and the fibrous blanket is between about 10 inches and about 24 inches wide and at least 3 inches thick.

5. The insulation sheet according to claim 1, wherein:

the insulation sheet is a fibrous blanket; the effective width of the fibrous blanket is at least ½ inch-greater than the width of the fibrous blanket at any given point along the length of the fibrous blanket; and the fibrous blanket is between about 10 inches and about 24 inches wide and at least 3 inches thick.

* * * * *